US009042588B2

(12) United States Patent
Aase

(10) Patent No.: US 9,042,588 B2
(45) Date of Patent: May 26, 2015

(54) PRESSURE SENSING EARBUDS AND SYSTEMS AND METHODS FOR THE USE THEREOF

(75) Inventor: Jonathan Aase, Redwood City, CA (US)

(73) Assignee: APPLE INC., Cupertino, CA (US)

( * ) Notice: Subject to any disclaimer, the term of this patent is extended or adjusted under 35 U.S.C. 154(b) by 875 days.

(21) Appl. No.: 13/251,074

(22) Filed: Sep. 30, 2011

(65) Prior Publication Data

US 2013/0083933 A1 Apr. 4, 2013

(51) Int. Cl.
*H04R 25/00* (2006.01)
*H04R 1/10* (2006.01)

(52) U.S. Cl.
CPC ..... *H04R 1/1041* (2013.01); *H04R 2420/07* (2013.01); *H04R 2430/01* (2013.01); *H04R 2430/03* (2013.01)

(58) Field of Classification Search
CPC ..... H04R 1/10; H04R 1/1041; H04R 1/105; H04R 1/1058; H04R 1/1083; H04R 2201/105; H04R 2201/107; H04R 2420/07; H04R 2430/01; H04R 2430/03
USPC ..... 381/56–58, 74, 380, 370, 322, 312, 381/328, 379; 181/135
See application file for complete search history.

(56) References Cited

U.S. PATENT DOCUMENTS

| | | | | |
|---|---|---|---|---|
| 8,705,787 | B2 * | 4/2014 | Larsen et al. | 381/380 |
| 8,750,527 | B2 * | 6/2014 | Tiscareno et al. | 381/58 |
| 2003/0108209 | A1 * | 6/2003 | McIntosh | 381/74 |
| 2011/0164128 | A1 * | 7/2011 | Burgett et al. | 348/77 |
| 2011/0164776 | A1 * | 7/2011 | Kelly et al. | 381/379 |

* cited by examiner

*Primary Examiner* — Lun-See Lao
(74) *Attorney, Agent, or Firm* — Van Court & Aldridge LLP

(57) ABSTRACT

Pressure sensing earbuds and systems are disclosed. The earbuds can include one or more pressure sensors to determine the size and shape of a user's ear. The pressure signals can be relayed back to a processor, which may use them to dynamically optimize the volume levels delivered for frequencies over the audible range for a particular user.

19 Claims, 9 Drawing Sheets

PRESSURE SENSING EARBUDS AND SYSTEMS AND METHODS FOR THE USE THEREOF

BACKGROUND

Headsets are commonly used with many portable electronic devices such as portable music players and mobile phones. Headsets can include non-cable components such as a jack, headphones, and/or a microphone and one or more cables that interconnect the non-cable components. Other headsets can be wireless. The headphones—the component that generates sound—can exist in many different form factors, such as over-the-hear headphones or as in-the-ear or in-the-canal earbuds.

SUMMARY

Pressure sensing earbuds and systems and methods for the use thereof are disclosed. Earbuds have one or more pressure sensors integrated within a housing of the earbud. Each pressure sensor includes an elastomeric material such as, for example, a quantum tunneling composite and first and second contacts disposed adjacent to the elastomeric material. The first and second contacts form a closed circuit via the elastomeric material when the elastomeric material receives an applied pressure that exceeds a predetermined threshold.

In one embodiment, a headset including at least one earbud and a plurality of pressure sensors integrated in the at least one earbud is provided, where each pressure sensor is operative to provide a signal. The headset also includes a processor electrically coupled to the headset and is operative to receive signals from the plurality of pressure sensors and determine a size of a user's ear. The headset can adjust a volume profile of audio signals being provided to the at least one earbud based on the determined size. As used herein, a volume profile can refer to the amount by which volume levels are adjusted over a frequency range to optimize sound playback for a particular frequency response. Adjustment of volume levels may be static or dynamic. For example, in some embodiments a user can manually instruct the processor to optimize volume levels for the user's ear dimensions. In other embodiments, the processor can automatically and continuously adjust volume levels based on signals from the pressure sensors. In some embodiments, the pressure sensors can determine whether the earbuds are properly positioned in a user's ear before the processor adjusts any volume levels.

Pressure sensors may be employed in a testing environment to determine the best size and shape earbuds for the general population in terms of fit and frequency response or to build a library of aural profiles. An aural profile can be a data file including an ear size and a measured frequency response for a particular earbud. For example, a number of different earbud shapes can be tested over a large population to determine which earbud shapes provide the best fit and frequency response for the largest population set. As another example, one particular earbud can be tested over a large population. Pressure signals corresponding to each user's ear size can be recorded along with the frequency response for each earbud and combined together in a data file to form an aural profile.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Pressure sensing headphones or earbuds for use in headsets are disclosed. Earbuds according to embodiments of this invention can include a non-occluding housing having one or more pressure sensors mounted on or in the housing. Non-occluding earbuds generally do not form an airtight seal with the user's ear. In general, the frequency response of an earbud can depend on many factors, including the characteristics of one or more speakers included in the housing, the size, shape, and material makeup of the housing, and the size and shape of a user's ear. The size, shape, and volume of at least the user's concha, tragus, anti-tragus, and external acoustic meatus (ear canal), which will hereinafter be referred to collectively as the user's ear size, can affect an earbud's frequency response. For non-occluding earbuds in particular, the absence of an airtight seal enhances the degree to which the user's ear size can affect the frequency response of the earbud, although the same principles can apply for occluding earbuds. In other words, the frequency response of the same earbud used in a small ear can be different than the frequency response of the same earbud used in a large ear.

Embodiments of this invention can use pressure sensors to determine the user's ear size in order to optimize volume levels over the audible range of frequencies for a particular earbud-ear system. As used herein, the term 'earbud-ear system' refers to the pairing of a particular earbud with a user's ear. Pressure sensors incorporated in or on an earbud can sense pressure between the earbud and the user's ear. Signals sensed at the pressure sensors can then be analyzed by a processor to determine the user's ear size.

In some embodiments, pressure sensors can employ an elastomeric material, such as a Quantum Tunneling Composite ("QTC") material, bounded by two conductors. The electrical resistance of a QTC decreases in proportion to the amount of force applied to the material, thereby allowing current to flow between the conductors for a given voltage. In other embodiments, other types of pressure sensors (e.g., piezoelectric or capacitive pressure sensors) can be used.

Figure 1A:
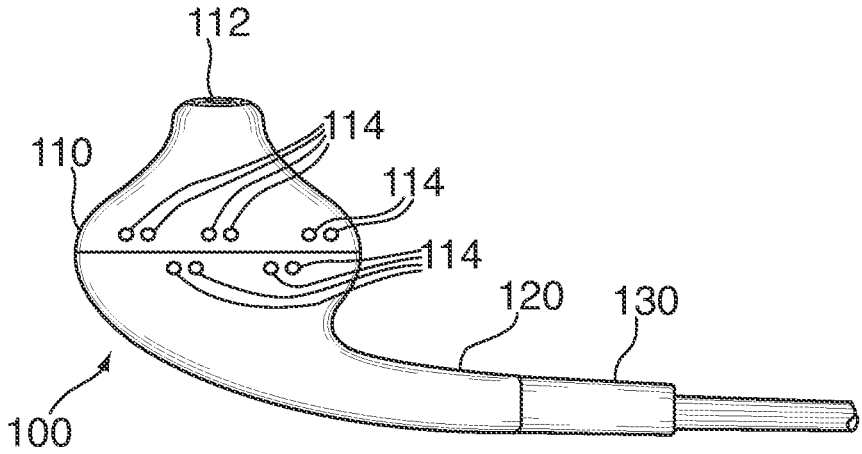
FIGS. 1A-D show illustrative views of an earbud in accordance with embodiments of the invention.
Figure 1B:
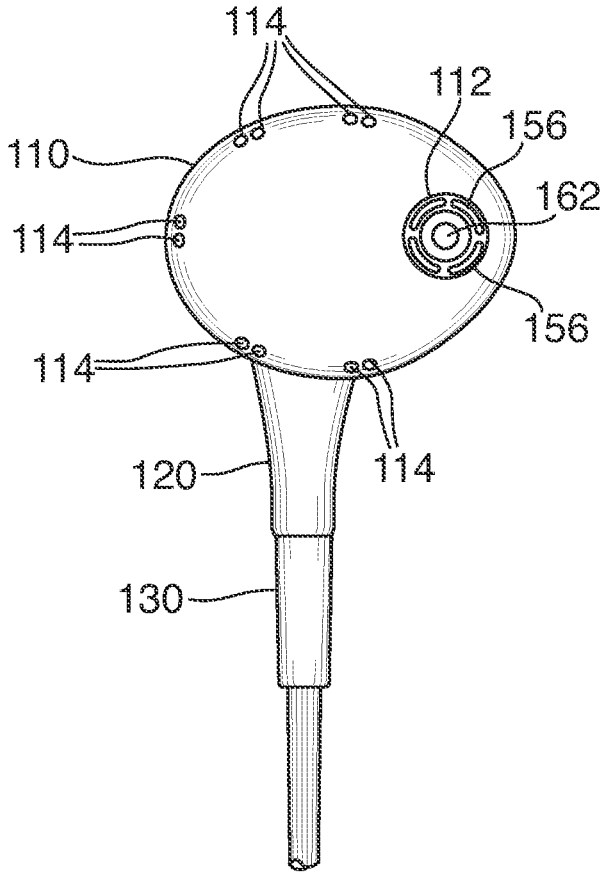

FIGS. 1A and 1B show illustrative views of earbud 100 in accordance with an embodiment of the invention. In particular, FIGS. 1A and 1B show side and front views of earbud 100, respectively. As shown, earbud 100 is a non-occluding earbud that is asymmetrically shaped along at least two orthogonal axes. Earbud 100 includes non-occluding member 110, directional port 112, neck member 120, strain relief member 130, and pressure sensors 114. Directional port 112 is offset so that when earbud 100 is placed in a user's ear, directional port 112 is positioned to direct sound directly into the user's ear canal. Pressure sensors 114 can be arranged on or in earbud 100 where earbud 100 is likely to come in contact with the user's ear. Earbud 100 can also include one or more speakers and a printed circuit board (none of which are shown).

Non-occluding member 110 is designed to fit in the ear of a user in a non-occluding manner. Non-occluding earbuds are generally designed not to form an airtight seal between the ear (or ear canal) and the outer surface of the earbud. By way of contrast, occluding earbuds are generally designed to fit inside of the user's ear canal and form a substantially airtight seal.

Signals from pressure sensors 114 can be sent to a processor (not shown) over a wired or wireless interface. The processor can reside within earbud 100, or in an electronic device (e.g., an iPhone™ or iPod™ available by Apple Inc. of Cupertino, Calif.) coupled to the headset that includes earbud 100. The processor can use the signals from pressure sensors 114 to determine the user's ear size. For example, pressure readings from one or more pressure sensors 114 can indicate, roughly, that a user has a small, medium, or large ear. Alternatively, pressure readings sent to the processor may allow a fine determination of the actual dimensions of the user's ear.

Based at least upon the pressure readings sent to the processor, volume levels for different frequencies can be dynamically (e.g., automatically and continuously) adjusted. For example, if it is determined that a user has a large ear, lower frequencies, corresponding to bass signals, may be boosted to compensate for a degraded frequency response over that lower frequency range. Likewise, if the user has a small ear, the volume of lower frequency bass signals may be reduced. The changes to volume levels in response to a particular frequency response may be referred to as a volume profile. In some embodiments, dynamic adjustment of volume levels may only occur when it is determined that the earbuds are properly inserted into the user's ear. That determination can also be made based on signals from pressure sensors 114. In other embodiments, a user may manually choose to enable or disable dynamic adjustment of volume levels or set the volume levels based on a single pressure reading.

According to some embodiments, pressure sensors can be used to build a library of aural profiles. Each aural profile can be a data file including an ear size and a measured frequency response for a particular earbud. The library can be constructed by measuring the frequency response of multiple users for one or more differently sized earbuds. As discussed above, an earbud can take any suitable size and shape, and coupled with the user's ear, that ear-earbud system has a particular frequency response. That frequency response can be measured using a microphone (not shown) which can, for example, be inserted in the earbud. The measured frequency response and the readings from pressure sensors 114 contribute to the aural profile.

The library of aural profiles can be used to build a library of volume profiles. Since the library of aural profiles has stored therein several different ear sizes and a corresponding measured frequency response, the library of volume profiles can leverage the aural library profiles to determine the extent to which the frequency response should be altered so that the user is provided with an optimal listening experience, regardless of the user's ear size and earbud.

Non-occluding member 110 can include two parts that are coupled together and cosmetically finished to provide the illusion that member 100 is a single piece construction. The two-part construction of member 110 is needed so that a speaker subassembly can be installed in earbud 100. Ports 156 and 162 can take any suitable shape and can include one or more ports. As shown, port 162 can be annular in shape and surrounded by one or more of ports 156.

Figure 1C:
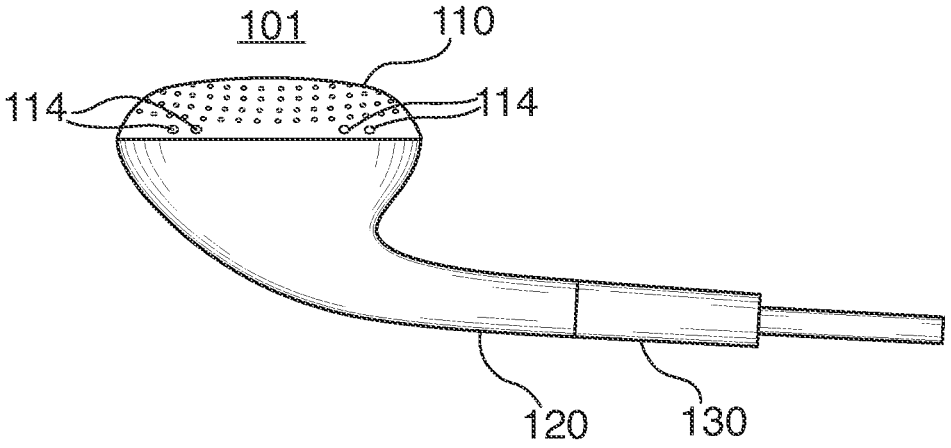
Figure 1D:
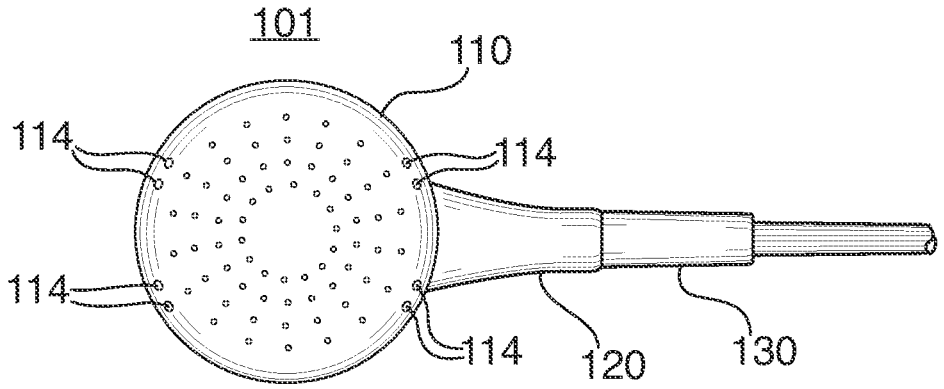

FIGS. 1C and 1D show illustrative views of earbud 101 in accordance with other embodiments of the invention. In particular, FIGS. 1A and 1B show side and front views of earbud 101, respectively. Earbud 101 can be a mono-speaker earbud including non-occluding member 110, neck 120, strain-relief member 130, and pressure sensors 114.

Figure 2:
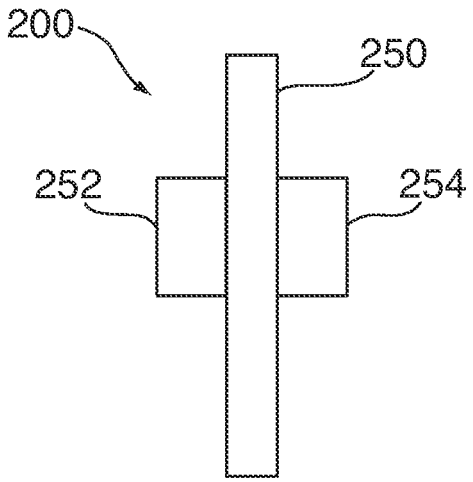
FIG. 2 shows an illustrative QTC pressure sensor in accordance with embodiments of the invention.

FIG. 2 shows an illustrative QTC pressure sensor 200 in accordance with embodiments of the invention. Sensor 200 includes QTC material 250 and contacts 252 and 254. When pressure is applied to QTC material 250, the electrical resistance of the material decreases proportionally and allows current to flow between contacts 252 and 254. Wires can be attached to contacts 252 and 254 in order to provide signals to a processor as described with respect to FIG. 1. In particular, a voltage may be induced between contacts 252 and 254. The amount of current flowing through sensor 200 can be measured in order to determine the pressure measured by sensor 200.

In some embodiments, contacts 252 and 254 can be inlaid into earbud 100 using laser direct structuring. Conducting patterns, created by laser direct structuring or any other suitable method, can extend from contacts 252 and 254 on the outer surface of earbud 100. In other embodiments, contacts 252 and 254 can extend through the surface of earbud 100 and couple to conventional wires or laser direct structured conductive patterns on the inner surface of earbud 100. To form sensor 200, a QTC material may be deposited on the surface of earbud 100. The QTC material can be deposited using any suitable technique, including, but not limited to, painting, dipping, spraying, or physical or chemical vapor deposition.

Figure 3A:
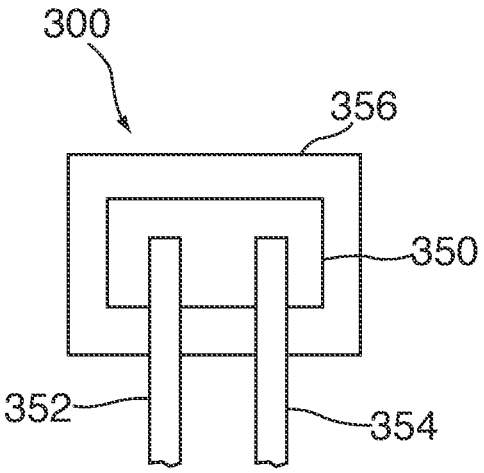
FIGS. 3A and 3B show illustrative views of a QTC pressure sensor in accordance with embodiments of the invention.
Figure 3B:
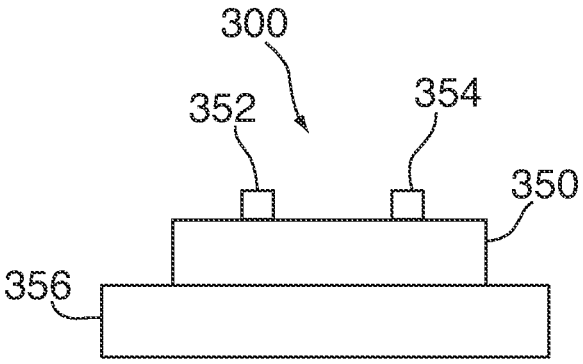

Referring now to FIGS. 3A and 3B, illustrative views of a QTC pressure sensor in accordance with embodiments of the invention are shown. In particular, top and side views of an exemplary QTC sensor 300 are shown in FIGS. 3A and 3B, respectively. Sensor 300 can include QTC material 350, contacts 352 and 354, and mounting pad 356. Sensor 300 can be configured to slide into a recessed slot (see FIG. 4) in earbud 100. Alternatively, sensor 300 may be mounted directly to the outer surface of earbud 100 (e.g., with an adhesive). As the QTC is compressed, contacts 352 and 354 become electrically connected, with the conductivity of the QTC material increasing proportionally with the level of compression.

Figure 4:
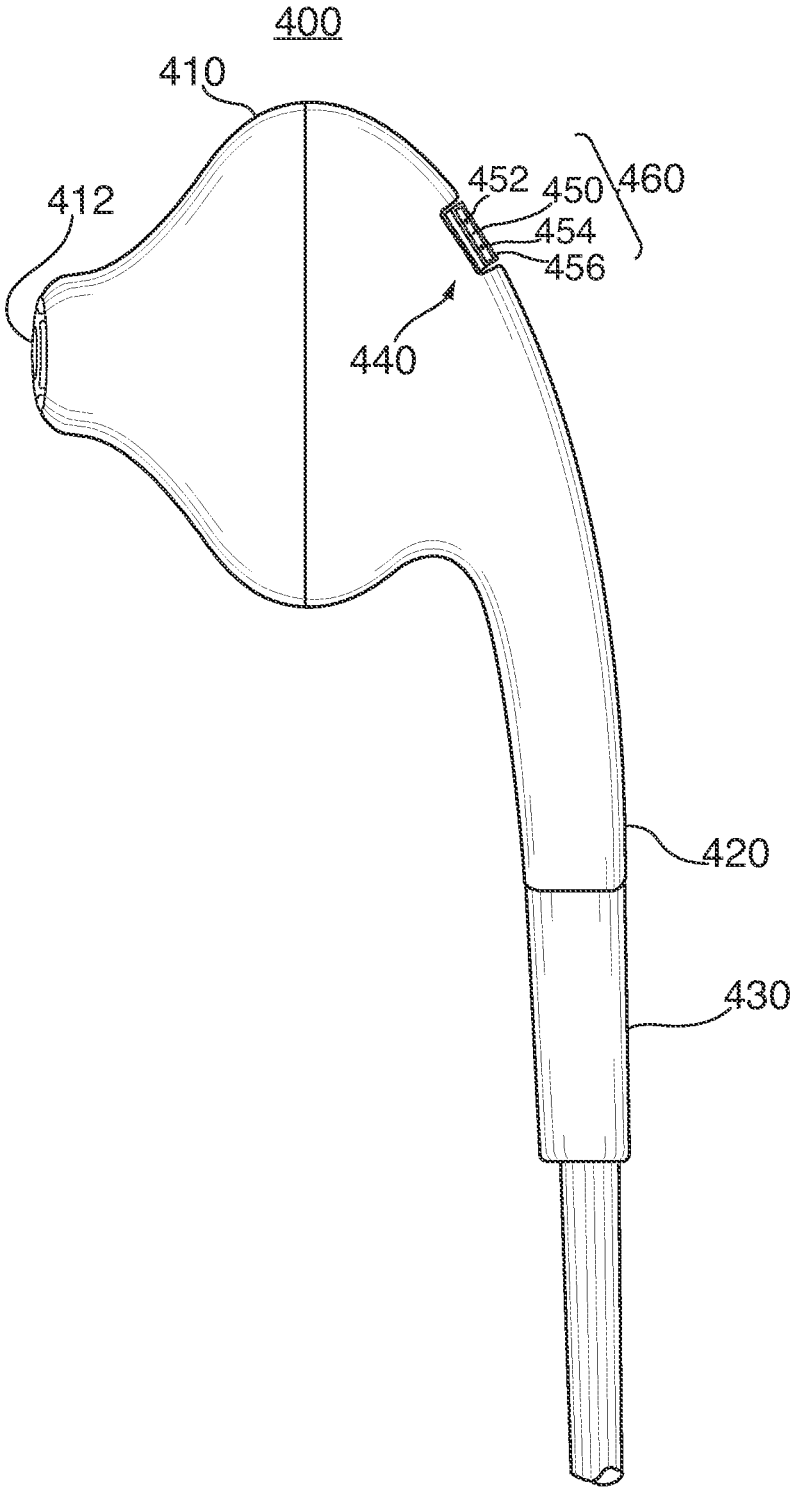
FIG. 4 shows illustrative views of an earbud in accordance with embodiments of the invention.

FIG. 4 shows an illustrative view of earbud 400 in accordance with some embodiments. Earbud 400 can include non-occluding member 410, directional port 412, neck member 420, strain relief member 430, cutout 440, and pressure sensor 460, including QTC material 450, contacts 452 and 454, and mounting pad 456. Mounting pad 456 can be mounted onto earbud 400 in a slot or groove provided in cutout 440. Mounting pad 456 may also be mounted to earbud 400 with an adhesive. In some embodiments, after the sensor has been mounted to earbud 400, cutout 440 can be filled in with a material that translates externally applied forces to pressure sensor 460 while maintaining an aesthetically pleasing appearance. For example, cutout 440 can be filled with the same material as earbud 400. Cutout 440 can then be sanded and polished to retain an aesthetically pleasing, seamless appearance. In other embodiments, cutout 440 can be filled with a pliable rubber, or rubber-like, material. Although only one cutout 440 and pressure sensor 460 are shown in FIG. 4, any number of sensors can be included. Additionally, any suitable pressure sensor (e.g., a piezoelectric or capacitive pressure sensor) may be substituted for QTC pressure sensor 460.

Figure 5:
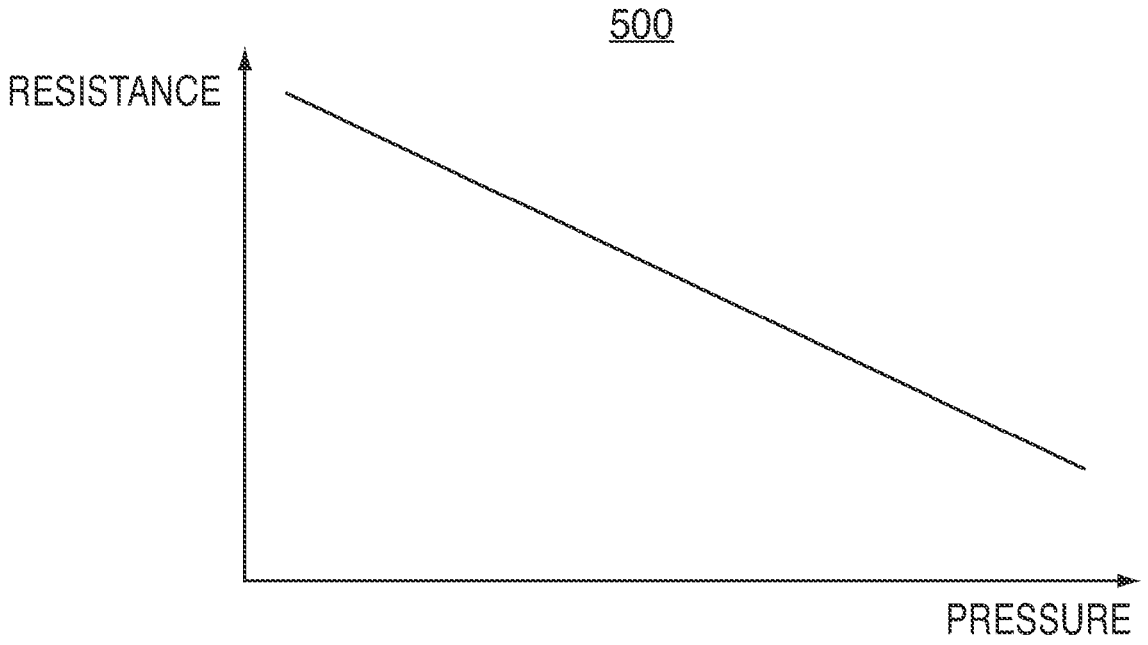
FIG. 5 shows an illustrative graphical view of the resistive response for a QTC pressure sensor in accordance with embodiments of the invention.

FIG. 5 shows an illustrative graphical view 500 of the resistive response for a QTC pressure sensor in accordance with some embodiments. The electrical resistance of a QTC material, as described herein in the context of pressure sensors, decreases proportionally in response to an applied pressure. For a given voltage induced across contacts mounted onto the QTC material, the current through the material will increase in response to increased pressure. Therefore, by measuring the current at a particular time, one can determine how much pressure is being applied to the sensor.

Figure 6:
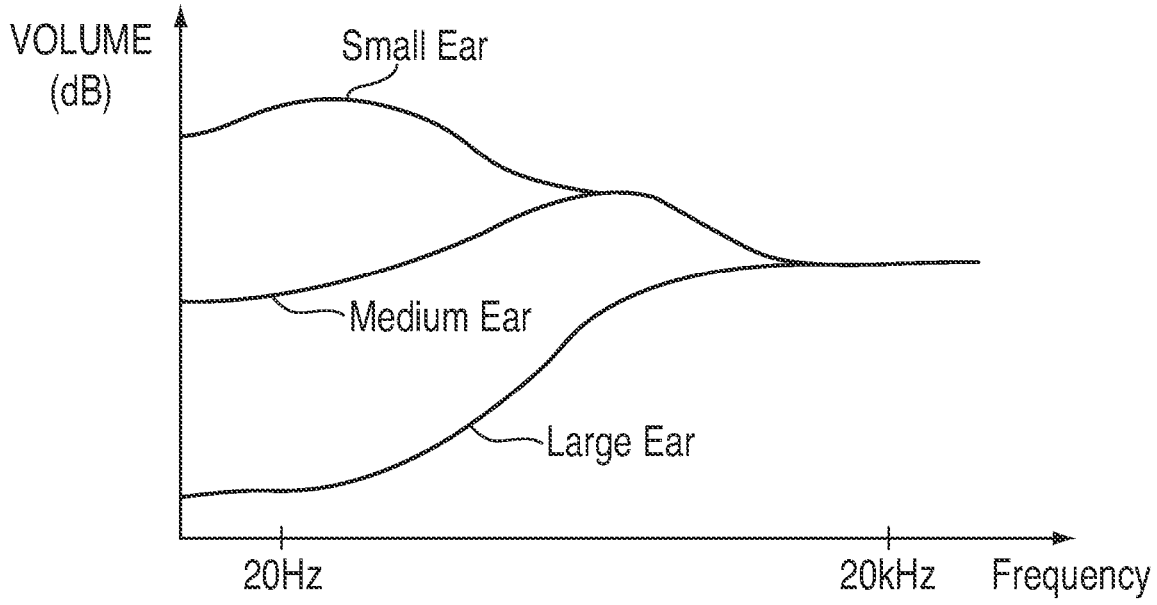
FIG. 6 shows an illustrative graphical view of the frequency responses of an earbud corresponding to different ear sizes in accordance with embodiments of the invention.

FIG. 6 shows an illustrative graphical view 600 of the frequency responses of an earbud corresponding to different ear sizes in accordance with some embodiments. As described above with respect to FIG. 1, the frequency response for an earbud can depend on a number of factors, including the quality of the speakers, the shape, size, and material composition of the earbud, and the user's ear size. The exemplary frequency responses shown in FIG. 6 correspond to three different ear-earbud systems (i.e., the same earbud used in small, medium, and large ears). On the low frequency end of the spectrum, signals corresponding to the large ear-earbud system are attenuated, while signals corresponding to the small ear-earbud system are enhanced. In order to maintain optimum volume levels across the entire frequency range, a system (e.g., system 700 of FIG. 7), according to some embodiments, may apply a particular volume profile based on the frequency response to raise the volume level of the low frequency, or bass, signals for the large ear-earbud system and lower the volume levels over that frequency range for a small ear-earbud system.

Figure 7:
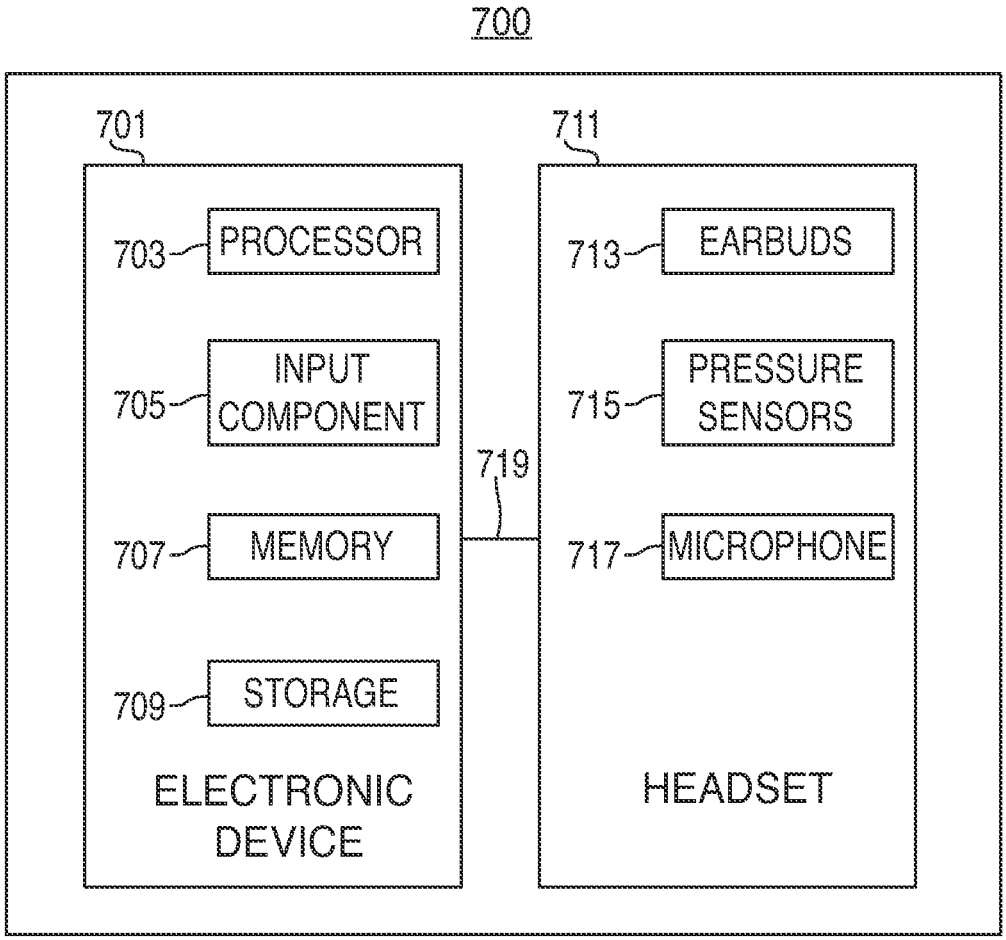
FIG. 7 shows an exemplary system in accordance with embodiments of the invention.

FIG. 7 is a schematic view of system 700 according to some embodiments. System 700 can include, among other components, electronic device 701, which may include processor 703, input component 705, memory 707, and storage 709, and headset 711, which may include earbuds 713 and pressure sensors 715. Electronic device 701 may be coupled to headset 711 through cable 719. Components 703, 705, 707, and, 709 may all be part of electronic device 701 or, alternatively, individual components may be connected to electronic device 701 in any suitable manner. For example, one or more components may be included in headset 711. As a further example, storage 711 may be a removable flash memory that can be coupled to electronic device 701 by a cable. Processor 703 may be connected to the other components of system 700 to control and operate electronic device 701. In some embodiments, processor 703 may execute instructions stored in memory 707. Processor 703 may include, for example, one or more software or firmware applications, a microcontroller, and/or a microprocessor. Processor 703 may also control input component 705.

Electronic device 701 may include, but is not limited to any device or group of devices, such as audio players, video players, music recorders, game players, other media players, music recorders, video recorders, cameras, other media recorders, radios, medical equipment, transportation vehicle instruments, calculators, cellular telephones, other wireless communication devices, personal digital assistants, programmable remote controls, pagers, laptop computers, desktop computers, printers, and combinations thereof. In some cases, electronic device 701 may perform multiple functions (e.g. play music, display video, store pictures, and receive and transmit telephone calls).

Moreover, in some cases, electronic device 701 may be any portable, electronic, hand-held, or miniature electronic device having a user interface constructed according to some embodiments that allows a user to use the device wherever the user travels. Miniature electronic devices may have a form factor that is smaller than that of hand-held electronic devices, such as an iPod™ available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for fitness equipment, key chains, and combinations thereof. Alternatively, electronic device 701 may not be portable at all, but may instead be generally stationary, such as a desktop computer or television.

Memory 707 can include one or more different types of memory that can be used to perform device functions. For example, memory 707 can include one or more of several caches, flash memory, RAM, ROM, and/or hybrid types of memory. According to some embodiments, pressure signals sent from pressure sensors mounted on one or more earbuds can be stored in memory 707.

Storage 709 may include one or more suitable storage mediums or mechanisms, such as a magnetic hard drive, flash drive, tape drive, optical drive, permanent memory (e.g., ROM), or cache. Storage 709 may be used for storing assets, such as audio and video files, text, pictures, graphics, contact information, or any other suitable user-specific or global information that may be used by electronic device 701. Storage 709 may also store programs or applications that can run on processor 703, may maintain files formatted to be read and edited by one or more of the applications, and may store any additional files that may aid the operation of one or more applications (e.g., files with metadata). In some embodiments, storage 709 may include some memory components that are fully integrated into electronic device 701, removably integrated into electronic device 101, or separate from electronic device 701. In the latter case, a separate storage component may be configured to communicate with electronic device 701 (e.g., using Bluetooth™ communication or a wired interface). It should be understood that any of the information stored on storage 709 instead be stored in memory 707 and vice versa.

Storage 709 may, according to some embodiments, also contain a library of aural profiles. For example, a library of aural profiles for a particular earbud (e.g., earbud 100 of FIG. 1) can be stored in storage 709. Each aural profile in the library can correspond to a measured frequency response for a given ear size. When a new user places an earbud according to embodiments of the invention into his or her ear, pressure signals can be measured and stored in memory 707. Ear canal pressure signals stored in memory 707 can then be compared to ear sizes stored in aural profiles in the library, and the appropriate frequency response can be determined for the user's ear size.

Upon determining the appropriate frequency response, processor 703 can automatically optimize the volume levels over the audible frequency range (e.g., 20 Hz-20 kHz) using a volume profile based on the frequency response. In some embodiments, processor 703 can continuously sample readings from the pressure sensors and dynamically adjust volume levels accordingly. In other embodiments, a user may use input component 705 to manually prompt processor 703 to recalculate the appropriate frequency response for a user's ear dimensions. For example, a user may want to set the proper frequency response entry once and keep it applied regardless of whether or not the earbud is perfectly placed in the user's ear. Audio playback may also be controlled based on whether or not the earbud is placed in the user's ear. For example, audio playback can automatically cease when the user removes the earbud from his or her ear. Similarly, audio playback can automatically begin when a user places an earbud in an ear. Pressure sensors 715, discussed in more detail below, can be used to determine whether an earbud is in a user's ear.

Input component 705 can allow a user with the ability to interact with electronic device 701. For example, input component 705 may provide an interface for a user to interact with an application running on processor 703. Input component 705 can take a variety of forms including, but not limited to, a keyboard/keypad, trackpad, mouse, click wheel, button, stylus, microphone, touch screen, or combinations of the foregoing. Input component 705 may also include one or more devices for user authentication (e.g., a smart card reader, fingerprint reader, or iris scanner) as well as an audio input device (e.g., a microphone) or a visual input device (e.g., a camera or video recorder) for recording video or still frames.

According to some embodiments, system 700 may include microphone 717 located in or around headset 711 that can sample the frequency response for a particular ear-earbud system. System 700 may also include one or more pressure sensors 715 incorporated into headset 711. In those and other embodiments, microphone 717 can sample the frequency response of an ear-earbud system over a broad frequency range and obtain the dimensions of a user's ear using pressure sensors 715 mounted on earbud 713. The combination of the frequency response data and the ear size can be saved as an aural profile in a library stored in storage 709.

Electronic device 701 may have one or more applications (e.g., software applications) stored on storage 709 or in memory 707. Processor 703 may be configured to execute instructions of the applications. Applications resident on electronic device 707 may include, for example, a telephony application, a GPS navigator application, a web browser application, a calendar or organizer application, or an email client. Electronic device 701 may also execute any suitable operating system, and can include a set of applications stored on storage 709 or memory 707 that is compatible with the particular operating system.

Earbuds according to embodiments of the invention can be included as part of a headset such as a wired headset or a wireless headset. An example of a wired headset is discussed below in connection with the description accompanying FIG. 8. A wireless headset can include, for example, a Bluetooth headset.

Figure 8:
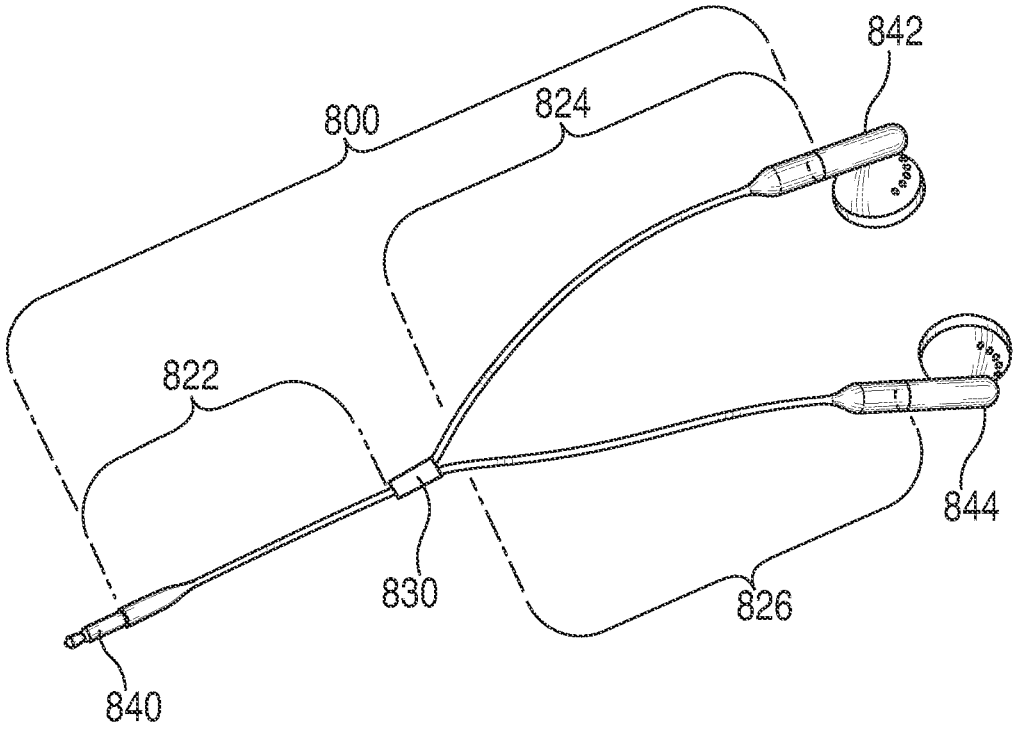
FIG. 8 shows an illustrative of wired a headset in accordance with embodiments of the invention.

FIG. 8 shows an illustrative headset 800 having cable structure 820 that integrates with non-cable components 840, 842, and 844. For example, non-cable components 840, 842, and 844 can be a male plug, left headphones, and right headphones, respectively. As a specific example, components 842 and 844 can be an earbud having one or more pressure sensors mounted on or in the housing. Cable structure 820 has three legs 822, 824, and 826 joined together at bifurcation region 830.

Leg 822 may be referred to herein as main leg 822, and includes the portion of cable structure 820 existing between non-cable component 840 and bifurcation region 830. Leg 824 may be referred to herein as left leg 824, and includes the portion of cable structure 820 existing between non-cable component 842 and bifurcation region 830. Leg 826 may be referred to herein as right leg 826, and includes the portion of cable structure 820 existing between non-cable component 844 and bifurcation region 830.

Cable structure 820 can include a conductor bundle that extends through some or all of legs 822, 824, and 826. Cable structure 820 can include conductors for carrying signals from non-cable component 840 to non-cable components 842 and 844 and vise versa. For example, signals from non-cable component 840 to non-cable components 842 and 844 can be audio signals. Signals from non-cable components 842 and 844 to non-cable component 840 can be pressure signals. Cable structure 820 can include one or more rods constructed from a superelastic material. The rods can resist deformation to reduce or prevent tangling of the legs. The rods are different than the conductors used to convey signals from non-cable component 840 to non-cable components 842 and 844, but share the same space within cable structure 820. Several different rod arrangements may be included in cable structure 820.

Figure 9:
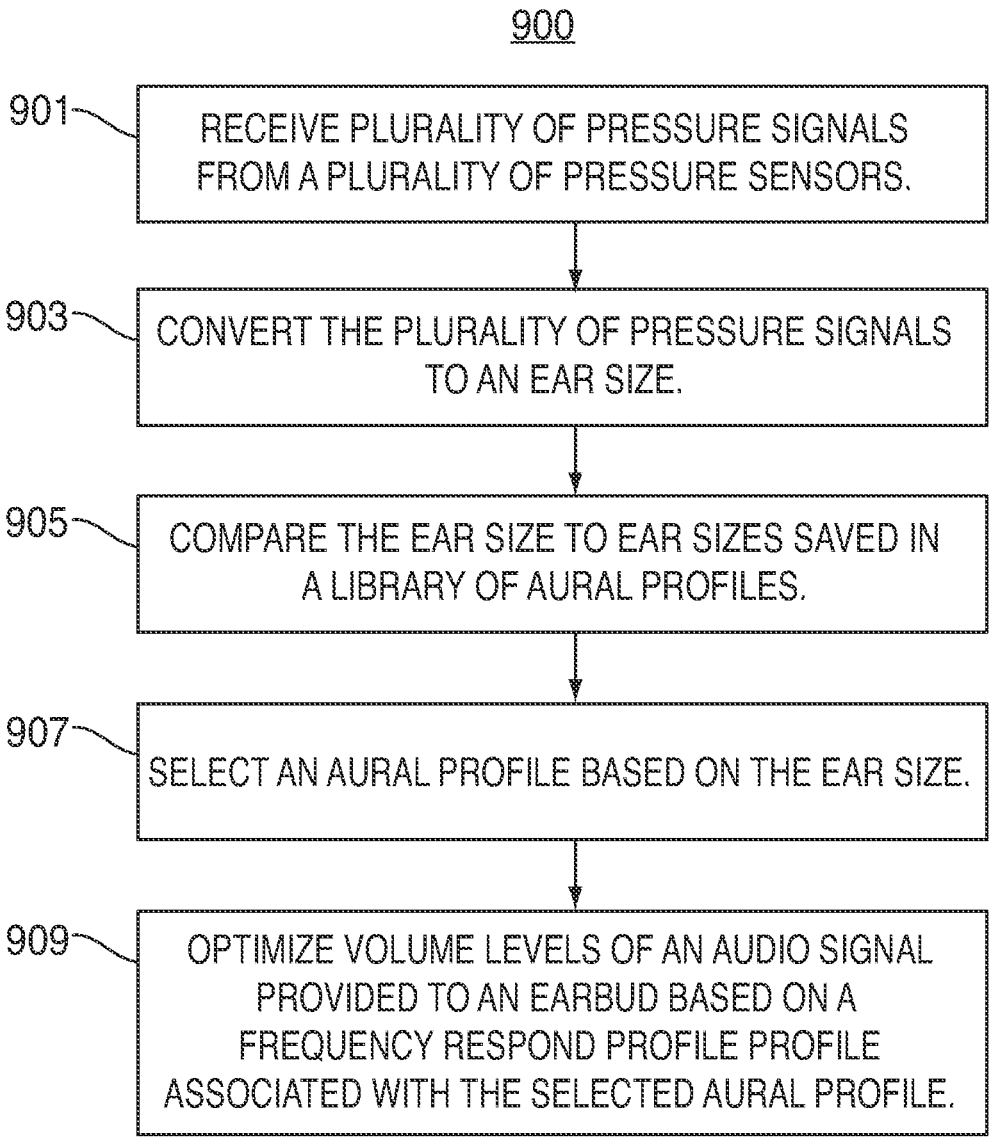
FIG. 9 is a flowchart of a process for adjusting volume levels based on pressure sensors included in an earbud in accordance with some embodiments of the invention.

FIG. 9 is a flowchart of process 900 for adjusting volume levels based on pressure sensors included in an earbud in accordance with some embodiments. In step 901, a processor can receive a number of pressure signals from pressure sensors disposed on or in an earbud. For example, when a user places earbuds according to embodiments of the invention in his ears, pressure signals can be transmitted from the pressure sensors to a processor. Next, in step 903, the processor can convert the received pressure signals into an ear size. Ear sizes can be rough approximations (e.g., small, medium, or large) or precise measurements of a user's ear.

In step 905, the converted ear size can be compared to ear sizes saved in a library of aural profiles. Each aural profile in the library can include ear sizes and a corresponding frequency response. In step 907, the processor can determine the aural profile that most closely matches the converted ear size. In step 909, the processor can optimize volume levels over the audible frequency range based on the frequency response associated with the determined aural profile. The optimized volume levels can make up a volume profile to be applied to an audio signal transmitted to the earbud.

Figure 10:
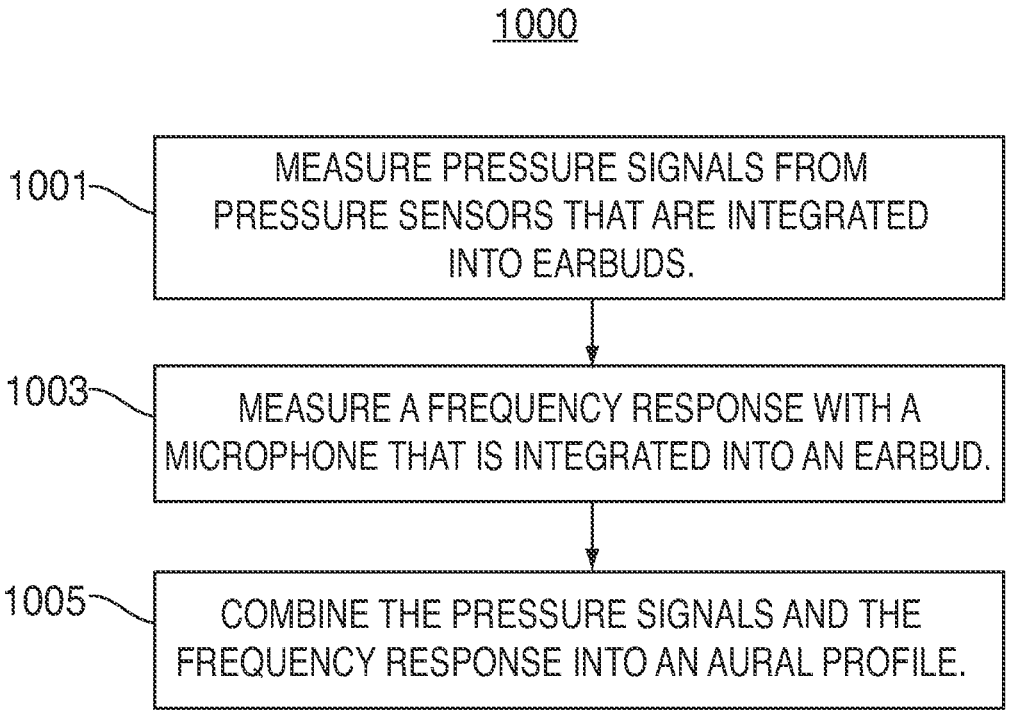
FIG. 10 is a flowchart of a process for creating a library or database of aural profiles in accordance with some embodiments of the invention.

FIG. 10 is a flowchart of process 1000 for creating a library or database of aural profiles in accordance with some embodiments. In step 1001, pressure signals from pressure sensors incorporated into an earbud can be measured. The pressure signals can correspond to a user's ear size. Next, in step 1003, a frequency response can be measured using a microphone. In particular, a number of frequencies can be played through an earbud, and the volume of each frequency can be measured by a microphone incorporated into the earbud. The frequencies played through the earbud can, according to some embodiments, be a finite number of discrete tones. In other embodiments, the frequencies can be varied smoothly over a predetermined frequency range (e.g., an audible range).

In step 1005, the measured pressure signals and frequency response can be combined together into an aural profile. For example, an aural profile can be a data file with two or more variables, including at least an ear size and a frequency response. Any number of aural profiles can be created using process 1000 and stored in a library or database for later reference.

It is to be understood that the steps shown in methods 900 and 1000 of FIGS. 9 and 10 are merely illustrative and that existing steps may be modified or omitted, additional steps may be added, and the order of certain steps may be altered.

While there have been described pressure sensing earbuds and systems and methods for the use thereof, it is to be understood that many changes may be made therein without departing from the spirit and scope of the invention. Insubstantial changes from the claimed subject matter as viewed by a person with ordinary skill in the art, no known or later devised, are expressly contemplated as being equivalently within the scope of the claims. Therefore, obvious substitutions now or later known to one with ordinary skill in the art are defined to be within the scope of the defined elements.

The described embodiments of the invention are presented for the purpose of illustration and not of limitation.

What is claimed is:

1. An audio system, comprising:

a headset, comprising:

at least one earbud; and a plurality of pressure sensors integrated in the at least one earbud, each pressure sensor operative to provide a signal; and a processor electrically coupled to the headset and operative to:

receive signals from the plurality of pressure sensors; and determine a size of a user's ear.

2. The audio system of claim 1, wherein the headset is a wireless headset.

3. The audio system of claim 1, wherein the headset is a wired headset.

4. The audio system of claim 1, wherein the at least one earbud is a non-occluding earbud.

5. The audio system of claim 1, wherein the processor is further operative to:

adjust a volume profile of audio signals being provided to the at least one earbud based on the determined size.

6. The audio system of claim 1, wherein the processor is further operative to:

determine whether the at least one earbud is in the user's ear; and control playback of media based on the determination of whether the at least one earbud is in the user's ear.

7. The audio system of claim 6, wherein the processor is further operative to cease playback of media when it is determined that the at least one earbud is not in the user's ear.

8. The audio system of claim 1, wherein a library of reference aural profiles is stored in at least one of a memory and storage, each reference ear profile having at least an associated ear size and frequency response.

9. The audio system of claim 8, wherein the processor is further operative to:

compare the user's ear size to ear sizes in the plurality of reference aural profiles;

determine which ear size in the plurality of reference aural profiles best fits the user's ear size; and select the aural profile associated with the ear size in the plurality of reference ear sizes that best fits the user's ear size.

10. The audio system of claim 9, wherein the processor is further operative to automatically adjust volume levels over a plurality of frequency ranges based at least on the frequency response associated with the selected aural profile.

11. The audio system of claim 9, wherein the processor is further operative to adjust volume levels over a plurality of frequency ranges based at least on the frequency response associated with the selected aural profile and an input command from a user.

12. The audio system of claim 1, wherein the processor resides within the at least one earbud.

13. The audio system of claim 1, wherein the processor is operative to receive the signals from the plurality of pressure sensors over a wireless interface.

14. The audio system of claim 1, wherein at least one pressure sensor of the plurality of pressure sensors comprises:

an elastomeric material; and first and second contacts disposed adjacent to the elastomeric material.

15. The audio system of claim 14, wherein the first and second contacts are operative to form a closed circuit via the elastomeric material when the elastomeric material receives an applied pressure that exceeds a predetermined threshold.

16. A method for using pressure sensing earbuds, comprising:

receiving a plurality of pressure signals from a plurality of pressure sensors integrated into at least one earbud;

converting the plurality of pressure signals into an ear size;

selecting an aural profile from a plurality of aural profiles based on the ear size, wherein the aural profile comprises:

an ear size; and a frequency response; and optimizing volume levels of an audio signal provided to at least one earbud based on a frequency response associated with the selected aural profile.

17. The method of claim 16, wherein selecting an aural profile comprises:

comparing the converted ear size to the ear sizes of a plurality of aural profiles;

determining which ear size of the plurality of aural profiles best fits the converted ear size; and selecting the aural profile associated with the ear size of the plurality of aural profiles that best fits the converted ear size.

18. The method of claim 16, wherein optimizing volume levels comprises changing amplitude of the audio signal for a predetermined frequency range.

19. The method of claim 16, wherein at least one of the converting, the selecting, and the optimizing occurs in the at least one earbud.

* * * * *